US009255777B1

(12) United States Patent
Campagnuolo et al.

(10) Patent No.: US 9,255,777 B1
(45) Date of Patent: Feb. 9, 2016

(54) GRENADE FUZE AND DETONATOR WITH FLYING DISC

(71) Applicants: Carl J. Campagnuolo, Sarasota, FL (US); James Varosh, Danville, CA (US); William J. Andrews, Tampa, FL (US); Vincent Gonsalves, Nazareth, PA (US)

(72) Inventors: Carl J. Campagnuolo, Sarasota, FL (US); James Varosh, Danville, CA (US); William J. Andrews, Tampa, FL (US); Vincent Gonsalves, Nazareth, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/276,145

(22) Filed: May 13, 2014

Related U.S. Application Data

(60) Provisional application No. 61/822,533, filed on May 13, 2013.

(51) Int. Cl.
*F42C 14/02* (2006.01)
*F42B 27/00* (2006.01)
*F42B 27/08* (2006.01)

(52) U.S. Cl.
CPC ..... *F42C 14/02* (2013.01); *F42B 27/08* (2013.01)

(58) Field of Classification Search
CPC ..... F42C 14/00; F42C 14/02; F42C 19/00; F42C 19/02; F42C 19/08; F42C 19/10; F42B 27/00; F42B 27/08; F42B 3/00
USPC ..... 102/200, 202, 204, 275.9, 275.11, 293, 102/482, 487, 499, 322
See application file for complete search history.

(56) References Cited

U.S. PATENT DOCUMENTS

| | | | | | |
|---|---|---|---|---|---|
| 1,878,491 | A * | 9/1932 | Goss | F42B 12/50 | 102/261 |
| 2,405,085 | A * | 7/1946 | Zappone | F42C 9/10 | 102/277.1 |
| 2,412,636 | A * | 12/1946 | Short | F42C 9/142 | 102/269 |
| 2,562,928 | A * | 8/1951 | Lewis | F42C 14/02 | 102/261 |
| 4,671,177 | A * | 6/1987 | Mayville | F42C 19/0815 | 102/204 |
| 4,926,752 | A * | 5/1990 | DiRubbio | F42C 14/02 | 102/202.13 |
| 5,196,649 | A * | 3/1993 | DiRubbio | F42C 14/02 | 102/486 |
| 5,229,542 | A * | 7/1993 | Bryan | F42B 3/113 | 102/201 |
| 5,355,803 | A * | 10/1994 | Robinet | F42C 14/02 | 102/254 |
| 8,887,640 | B1 * | 11/2014 | Knight | F42C 14/025 | 102/210 |
| 2012/0240806 | A1 * | 9/2012 | Gonsalves | C06B 21/0041 | 102/275.11 |

* cited by examiner

*Primary Examiner* — Jonathan C Weber
(74) *Attorney, Agent, or Firm* — Michael C. Sachs

(57) ABSTRACT

A more IM compliant energetics train for a grenade fuze or a detonator includes an explosive charge containing PBXN-5 and a first charge containing PBX-9407 disposed adjacent to the PBXN-5 explosive charge. A flying disc is disposed adjacent to the first charge of PBX-9407. A barrel has one end disposed adjacent to the flying disc and an opposite end disposed adjacent to a second charge containing PBX-9407. Detonation of the first charge containing PBX-9407 causes the flying disc to accelerate through the barrel, impact the second charge containing PBX-9407 and detonate the second charge containing PBX-9407.

18 Claims, 5 Drawing Sheets

GRENADE FUZE AND DETONATOR WITH FLYING DISC

CROSS-REFERENCE TO RELATED APPLICATIONS

The present application claims the benefit of priority of U.S. provisional patent application Ser. No. 61/822,533 filed on May 13, 2013, which is incorporated by reference herein.

STATEMENT OF GOVERNMENT INTEREST

The inventions described herein may be manufactured, used and licensed by or for the United States Government.

BACKGROUND OF THE INVENTION

The invention relates in general to fuzes and detonators for munitions and in particular to the Insensitive Munitions (IM) compliance requirements for fuzes and detonators.

A primary explosive is an explosive that is extremely sensitive to stimuli such as impact, friction, heat, static electricity, or electromagnetic radiation. A relatively small amount of energy is required for initiation of a primary explosive. Primary explosives are often used in fuzes and detonators to trigger larger charges of less sensitive secondary explosives.

A major concern in the field of fuzing and detonators is the ability to meet the Insensitive Munitions (IM) compliance requirements. Specifically, stimuli such as bullets, fragments and shape charge impacts are difficult IM challenges for detonators and fuzes. In particular, the primary energetics or explosives in these items are sensitive to the IM stimuli and may initiate the complete energetic train of a munition in a high order detonation.

Detonators and fuzes are similar in design and may use the same or similar types of energetics to attain the high order reaction. Detonators and/or fuzes may use primary and secondary energetics to achieve the needed detonation reaction speeds/velocities. Examples of primary energetics are materials such as lead azide, lead styphnate, RDX and others. Examples of secondary energetics are materials such as PBX-9407, PBXN-5, PBXN-107, PBXN-109 and others. The primary energetics are more sensitive to impact stimuli than the secondary energetics.

FIG. 1 is a sectional view of a known grenade fuze assembly 10. Fuze assembly 10 includes a fuze body 12 with a striker lever 14 rotatably mounted thereon. A rotor assembly 16 including a firing pin 18 is rotatably mounted to body 12. A spring 20 torsionally biases rotor assembly 16 in a counterclockwise direction. Spring 20 causes firing pin 18 to rotate counterclockwise and impact primer 22. The impact of firing pin 18 ignites primer 22. Primer 22 initiates an energetics train 24 disposed in fuze body 12. Energetics train 24 includes a delay mix 26, lead styphnate 28, lead azide 30, and RDX 32.

The primer 22 initiates the delay mix 26. The delay mix 26 provides a time delay, for example, a few seconds, before the delay mix 26 initiates the lead styphnate 28. The lead styphnate 28 initiates the lead azide 30. The lead azide 30 initiates the RDX 32. The RDX 32 initiates the main charge (not shown) in the grenade, for example, Composition B.

FIG. 2 is a sectional view of a known detonator 40 having a case or housing 42, a shock tube or detonation cord 44, lead styphnate 46, lead azide 48 and RDX 50. The shock or detonation cord 44 initiates the energetic reaction by initiating the lead styphnate 46. The lead styphnate 46 initiates the lead azide 48. The lead azide 48 initiates the RDX 50. The RDX 50 initiates the main charge (not shown) which may be, for example, plastic explosives, shape charges or other explosives.

In the grenade fuze 10 and the detonator 40, the primary energetics are lead styphnate 28, 46, lead azide 30, 48 and RDX 32, 50. In the fuze 10, the percussion primer 22 is also a primary energetic. These primary energetics are sensitive to stimuli such as bullet, fragment and shape charge impact and are problematic for IM compliance.

A need exists for fuzes and detonators that are less sensitive to impacts than known fuzes and detonators.

SUMMARY OF INVENTION

One aspect of the invention is an apparatus having an energetics train. The energetics train includes an explosive charge containing PBXN-5 and a first charge containing PBX-9407 disposed adjacent to the PBXN-5 explosive charge. A flying disc is disposed adjacent to the first charge of PBX-9407. One end of a barrel is disposed adjacent to the flying disc. A second charge containing PBX-9407 is disposed adjacent to an opposite end of the barrel. The detonation of the first charge containing PBX-9407 causes the flying disc to accelerate through the barrel, impact the second charge containing PBX-9407 and detonate the second charge containing PBX-9407.

In one embodiment, the apparatus is a grenade fuze assembly. The grenade fuze assembly includes a grenade fuze body and a striker lever rotatably attached to the grenade fuze body. A spring-loaded rotor assembly is rotatably fixed to the grenade fuze body. The energetics train is disposed in the grenade fuze body. A primer is disposed in the grenade fuze assembly.

In another embodiment, the apparatus is a detonator. The detonator includes a generally longitudinal detonator housing with the energetics train disposed therein. One of a shock tube and a detonation cord may be disposed at one end of the detonator housing in explosive communication with the explosive charge containing PBXN-5.

Another aspect of the invention is a method of initiating energetic material. The method includes providing the novel energetics train and detonating the explosive charge containing PBXN-5. The explosive charge containing PBXN-5 is used to detonate the first charge containing PBX-9407. Detonation of the first charge containing PBX-9407 accelerates the flying disc through the barrel. The flying disc detonates the second charge containing PBX-9407.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
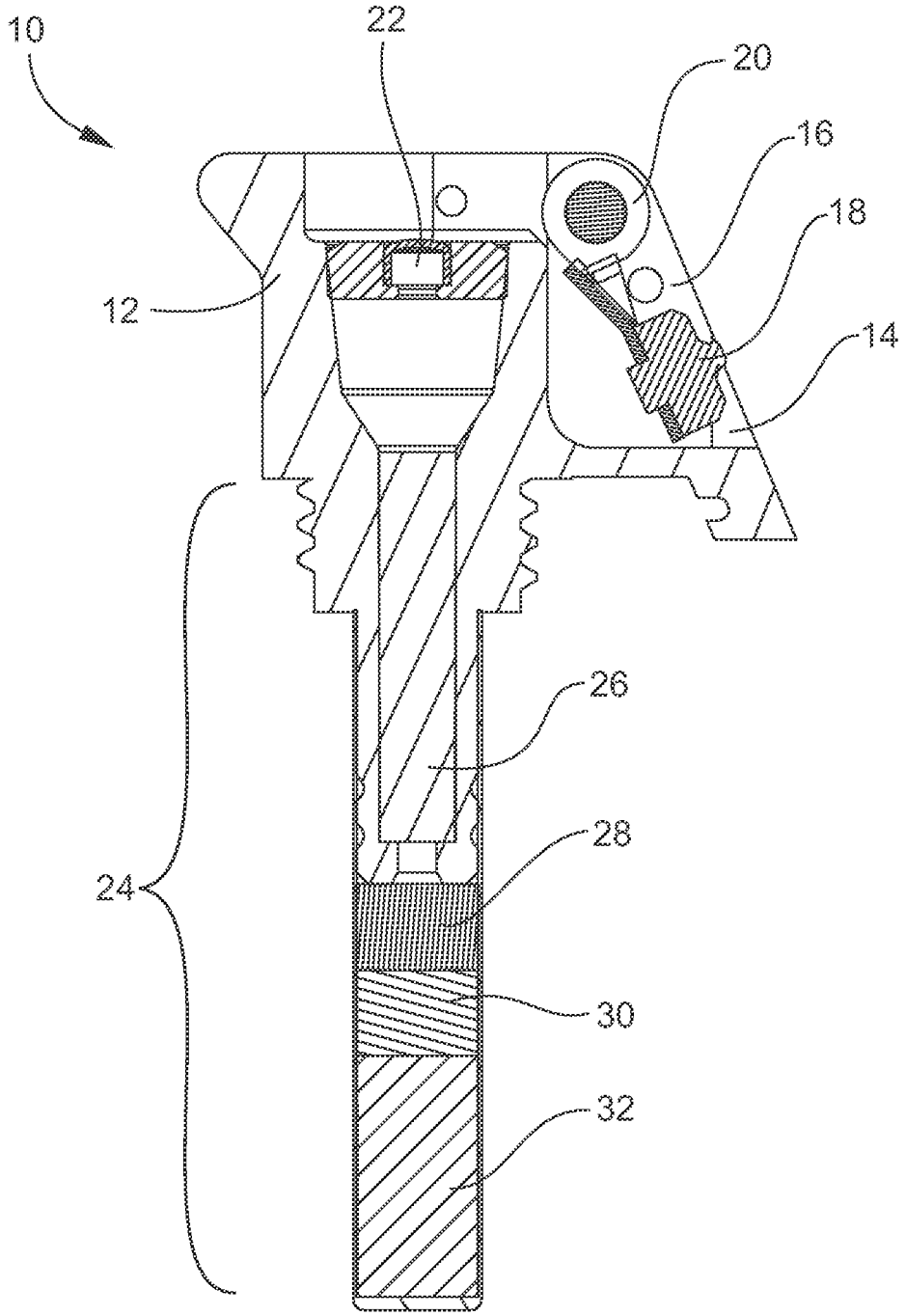
FIG. 1 PRIOR ART
FIG. 1 is a sectional view of a known grenade fuze assembly.
Figure 2:
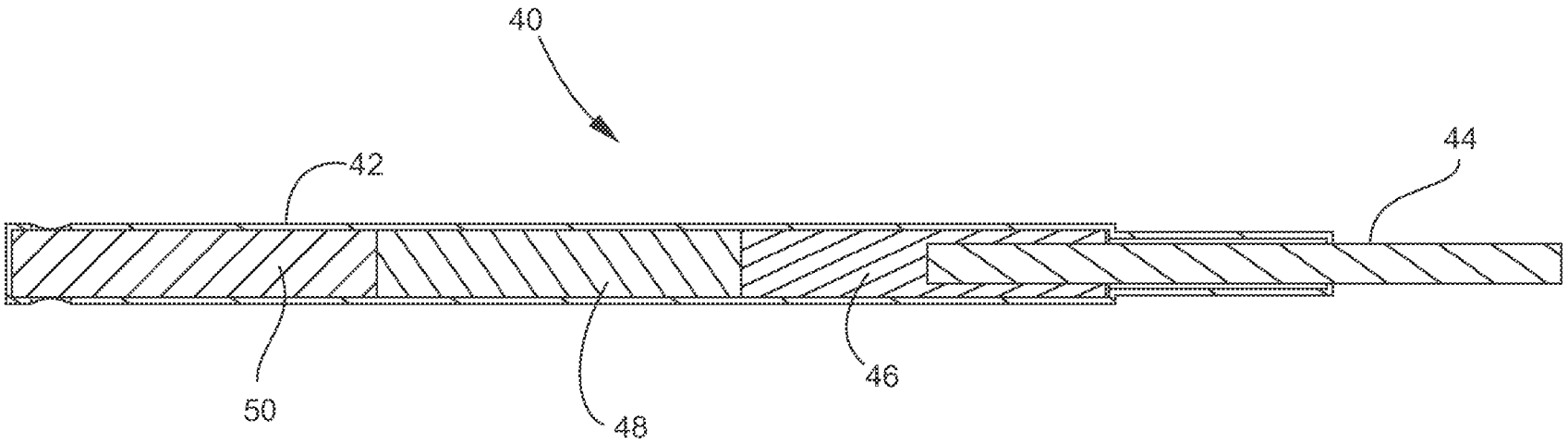
FIG. 2 PRIOR ART
FIG. 2 is a sectional view of a known detonator.
Figure 3:
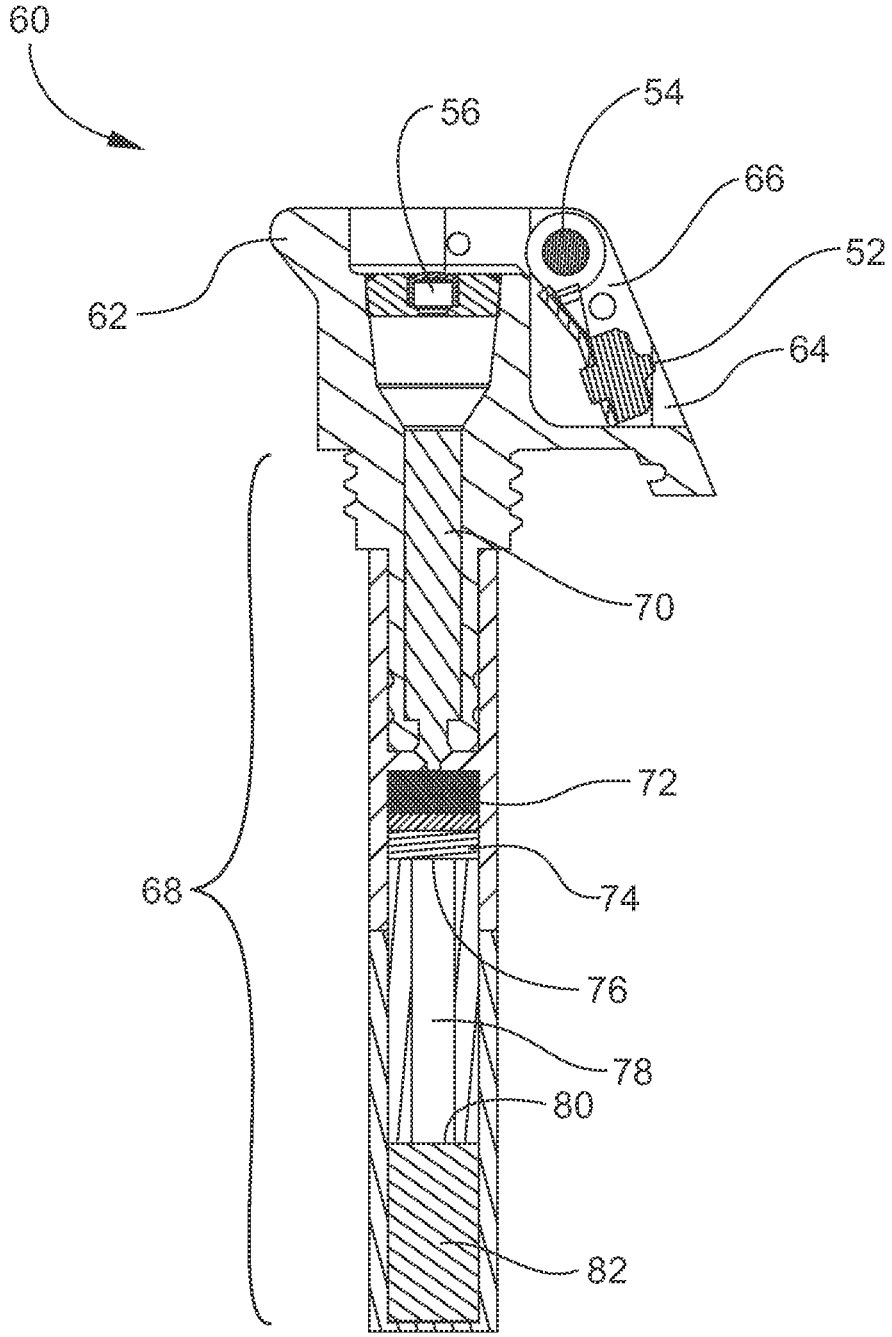
FIG. 3 is a sectional view of one embodiment of a novel grenade fuze assembly.

FIG. 3 is a sectional view of one embodiment of a novel grenade fuze assembly 60. Assembly 60 includes a fuze body 62, a striker lever 64 rotatably attached to the fuze body 62 and a spring-loaded rotor assembly 66 rotatably fixed to the fuze body 62. Rotor assembly 66 includes a firing pin 52. A spring 54 torsionally biases rotor assembly 66 in a counterclockwise direction. Spring 54 causes firing pin 52 to rotate counterclockwise and impact a primer 56. The impact of firing pin 52 ignites primer 56. Primer 56 initiates an energetics train 68 disposed in fuze body 62.

The energetics train 68 includes a charge 70 containing PBXN-5 followed by a first PBX-9407 charge 72. A flying disc 74 is disposed adjacent to the first charge 72 of PBX-9407. Flying disc 74 may be made of, for example, aluminum. One end 76 of a barrel 78 is disposed adjacent to the flying disc 74 and another end 80 of the barrel 78 is disposed adjacent to a second PBX-9407 charge 82. Detonation of the first PBX-9407 charge 72 causes the flying disc 74 to accelerate through the barrel 78. Flying disc 74 impacts the second PBX-9407 charge 82 thereby detonating the second PBX-9407 charge 82. The second PBX-9407 charge 82 initiates the main charge (not shown) in the grenade, for example, Composition B.

Because energetics train 68 includes only secondary explosives, the only primary explosive in fuze assembly 60 is the primer 56. Thus, compared to fuze assembly 10, fuze assembly 60 has much less surface area that is sensitive to impact from bullets, fragments and shaped charges.

Figure 4:
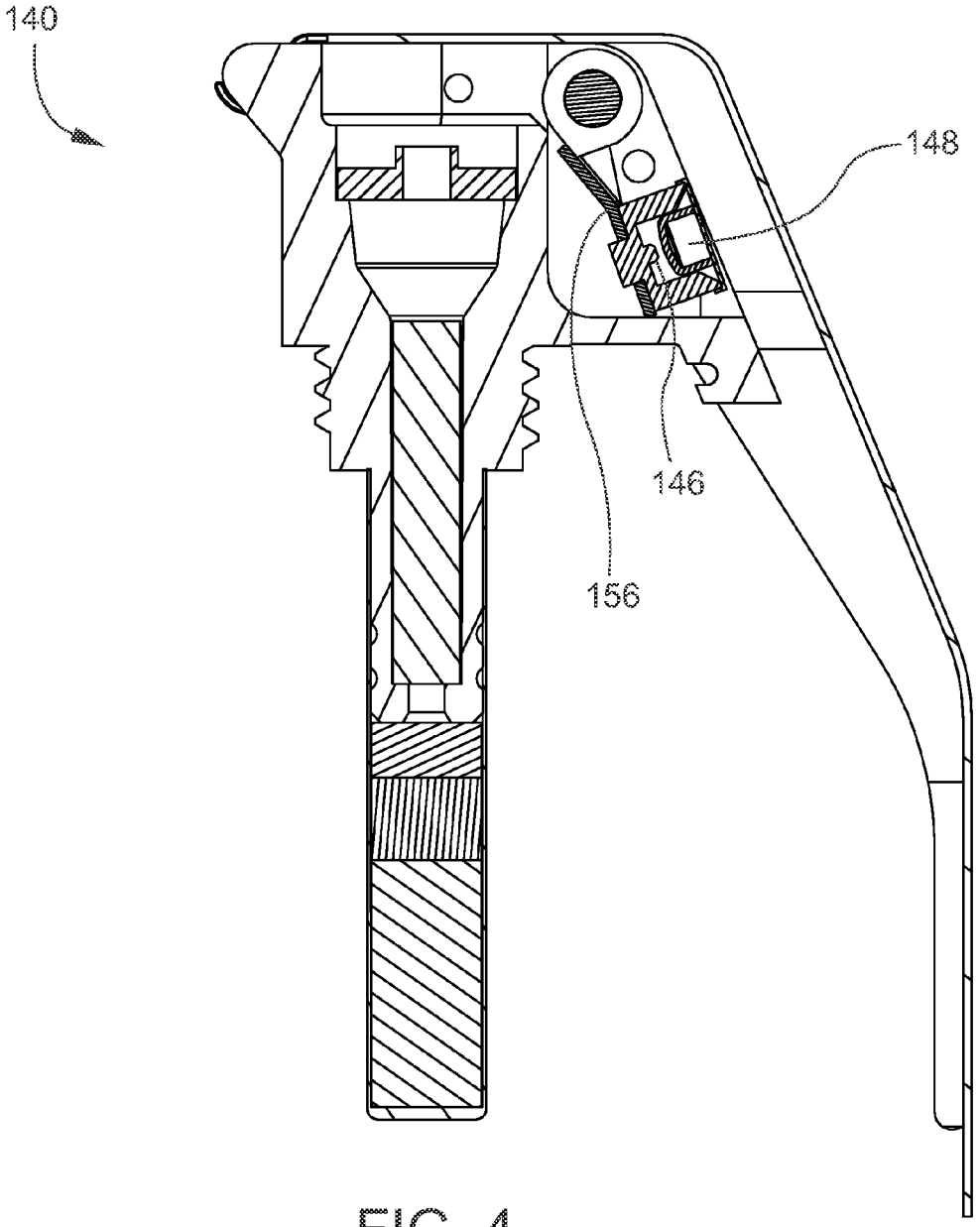
FIG. 4 is a sectional view of another embodiment of a grenade fuze assembly.

In FIG. 3, primer 56 containing primary explosive is disposed in-line with energetics train 68. Alternatively, primer 56 may be out-of-line with energetics train 68. For example, as shown in FIG. 4, a fuze assembly 140 has a primer 148 and firing pin 146 disposed in a rotor assembly 156. The placement of the primer 148 in rotor assembly 156 is described in more detail in commonly-owned U.S. non-provisional patent application Ser. No. 14/014,723 filed on Aug. 20, 2013 and entitled "Flying Primer for Hand Grenade Fuze." The U.S. non-provisional patent application Ser. No. 14/014,723 is expressly incorporated by reference herein. When the primer is disposed in the rotor assembly and out-of-line with the energetics train, as in FIG. 4, the detonation of the primary explosive in the primer will not cause the energetics train to detonate. Thus, with primer 56 disposed in rotor assembly 66, the entire fuze assembly 60 meets IM compliance standards.

Figure 5:
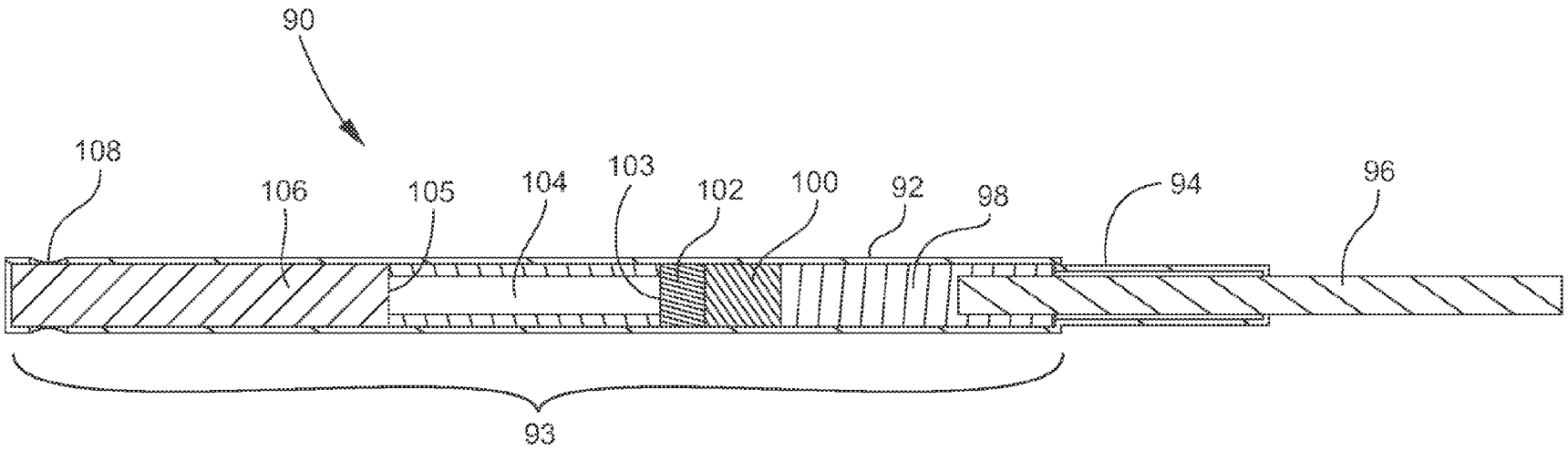
FIG. 5 is a sectional view of one embodiment of a novel detonator.

FIG. 5 is a sectional view of a novel detonator 90 including a generally longitudinal detonator housing 92. Disposed in housing 92 is an energetics train 93. Energetics train 93 includes a charge 98 containing PBXN-5 followed by a first PBX-9407 charge 100. A flying disc 102 is disposed adjacent to the first charge 100 of PBX-9407. Flying disc 102 may be made of, for example, aluminum. One end 103 of a barrel 104 is disposed adjacent to the flying disc 102 and another end 105 of the barrel 104 is disposed adjacent to a second PBX-9407 charge 106. Detonation of the first PBX-9407 charge 98 causes the flying disc 102 to accelerate through the barrel 104. Flying disc 102 impacts the second PBX-9407 charge 106 thereby detonating the second PBX-9407 charge 106. The second PBX-9407 charge 106 initiates the main charge (not shown) via, for example, openings 108 in housing 92.

The PBXN-5 charge 98 may be detonated by a component 96 disposed at end 94 of housing 92. Component 96 may be, for example, a shock tube or detonation cord. Because energetics train 93 includes only secondary explosives, detonator 90 has much less surface area that is sensitive to impact from bullets, fragments and shaped charges, compared to prior art detonator 40.

While the invention has been described with reference to certain embodiments, numerous changes, alterations and modifications to the described embodiments are possible without departing from the spirit and scope of the invention as defined in the appended claims, and equivalents thereof.

What is claimed is:

1. An apparatus, comprising:
an energetics train including
an explosive charge containing PBXN-5;
a first charge containing PBX-9407 disposed adjacent to the PBXN-5 explosive charge;
a flying disc disposed adjacent to the first charge of PBX-9407;
a barrel having one end disposed adjacent to the flying disc; and
a second charge containing PBX-9407 disposed adjacent to an opposite end of the barrel;
wherein detonation of the first charge containing PBX-9407 causes the flying disc to accelerate through the barrel, impact the second charge containing PBX-9407 and detonate the second charge containing PBX-9407.

2. The apparatus of claim 1, further comprising
a grenade fuze body;
a striker lever rotatably attached to the grenade fuze body; and
a spring-loaded rotor assembly rotatably fixed to the grenade fuze body;
wherein the energetics train is disposed in the grenade fuze body and the apparatus is a grenade fuze assembly.

3. The apparatus of claim 2, further comprising a primer disposed in the grenade fuze assembly.

4. The apparatus of claim 3, wherein, in an unarmed state of the grenade fuze assembly, the primer is disposed in the grenade fuze body in-line with the energetics train.

5. The apparatus of claim 3, wherein, in an unarmed state of the grenade fuze assembly, the primer is disposed in the spring-loaded rotor assembly out-of-line with the energetics train.

6. The apparatus of claim 1, wherein the flying disk is made of aluminum.

7. The apparatus of claim 1, further comprising
a generally longitudinal detonator housing with the energetics train disposed therein; and
one of a shock tube and a detonation cord disposed at one end of the detonator housing in explosive communication with the explosive charge containing PBXN-5;
wherein the apparatus is a detonator.

8. A method of initiating energetic material, comprising:
providing the apparatus of claim 1;
detonating the explosive charge containing PBXN-5;
using the explosive charge containing PBXN-5 to detonate the first charge containing PBX-9407;
using the first charge containing PBX-9407 to accelerate the flying disc through the barrel; and
detonating the second charge containing PBX-9407 with the flying disc.

9. The method of claim 8, wherein the step of providing includes providing the energetics train in a grenade fuze body.

10. The method of claim 9, wherein the step of detonating the explosive charge containing PBXN-5 includes detonating using a primer.

11. The method of claim 8, wherein the step of providing includes providing the energetics train in a generally longitudinal detonator housing.

12. The method of claim 11, wherein the step of detonating the explosive charge containing PBXN-5 includes detonating using one of a shock tube and a detonation cord.

13. A grenade fuze assembly, comprising:

a grenade fuze body;

a striker lever rotatably attached to the grenade fuze body;

a spring-loaded rotor assembly rotatably fixed to the grenade fuze body; and an energetics train disposed in the grenade fuze body, the energetics train including an explosive charge containing PBXN-5;

a first charge containing PBX-9407 disposed adjacent to the PBXN-5 explosive charge;

a flying disc disposed adjacent to the first charge of PBX-9407;

a barrel having one end disposed adjacent to the flying disc; and a second charge containing PBX-9407 disposed adjacent to an opposite end of the barrel;

wherein detonation of the first charge containing PBX-9407 causes the flying disc to accelerate through the barrel, impact the second charge containing PBX-9407 and detonate the second charge containing PBX-9407.

14. The grenade fuze assembly of claim 13, further comprising a primer disposed in the grenade fuze assembly.

15. The grenade fuze assembly of claim 14, wherein, in an unarmed state of the grenade fuze assembly, the primer is disposed in the grenade fuze body in-line with the energetics train.

16. The grenade fuze assembly of claim 14, wherein, in an unarmed state of the grenade fuze assembly, the primer is disposed in the spring-loaded rotor assembly out-of-line with the energetics train.

17. The grenade fuze assembly of claim 14, wherein the flying disk is made of aluminum.

18. A detonator, comprising:

a generally longitudinal detonator housing;

an energetics train disposed in the detonator housing, the energetics train including an explosive charge containing PBXN-5;

a first charge containing PBX-9407 disposed adjacent to the PBXN-5 explosive charge;

a flying disc disposed adjacent to the first charge of PBX-9407;

a barrel having one end disposed adjacent to the flying disc; and a second charge containing PBX-9407 disposed adjacent to an opposite end of the barrel; wherein detonation of the first charge containing PBX-9407 causes the flying disc to accelerate through the barrel, impact the second charge containing PBX-9407 and detonate the second charge containing PBX-9407; and one of a shock tube and a detonation cord disposed at one end of the detonator housing in explosive communication with the explosive charge containing PBXN-5.

* * * * *